US006186047B1

(12) United States Patent
Baruffaldi

(10) Patent No.: US 6,186,047 B1
(45) Date of Patent: Feb. 13, 2001

(54) DEVICE FOR LOCKING THE SLIDING OF THE ROD OF A LINEAR ACTUATOR AND A LINEAR ACTUATOR PROVIDED WITH THE DEVICE

(75) Inventor: Danilo Baruffaldi, Torino (IT)

(73) Assignee: Ready S.R.L., Turin (IT)

( * ) Notice: Under 35 U.S.C. 154(b), the term of this patent shall be extended for 0 days.

(21) Appl. No.: 09/125,159

(22) PCT Filed: Feb. 12, 1997

(86) PCT No.: PCT/EP97/00632

§ 371 Date: Aug. 13, 1999

§ 102(e) Date: Aug. 13, 1999

(87) PCT Pub. No.: WO97/30291

PCT Pub. Date: Aug. 21, 1997

(30) Foreign Application Priority Data

Feb. 14, 1996 (IT) ..... T096A0100

(51) Int. Cl.[7] ..... F15B 15/26
(52) U.S. Cl. ..... 92/24; 92/28
(58) Field of Search ..... 92/19, 23, 24, 92/25, 27, 26, 28; 91/44, 45

(56) References Cited

U.S. PATENT DOCUMENTS 2,139,185 * 12/1938 Engel ..... 91/44
3,050,943 * 8/1962 Thorel et al. ..... 92/23
3,107,582 * 10/1963 Royster ..... 92/24
3,217,609 11/1965 Royster .
3,251,278 5/1966 Royster .
4,791,856 * 12/1988 Heim et al. ..... 92/25

FOREIGN PATENT DOCUMENTS 2 219 824 10/1973 (DE) .
33 19 402 11/1984 (DE) .
0 103 555 3/1984 (EP) .
2 185 532 7/1987 (GB) .
48261 * 5/1918 (SE) ..... 92/24

OTHER PUBLICATIONS

International Search Report for PCT/EP97/00632.

* cited by examiner

*Primary Examiner*—Edward K. Look
*Assistant Examiner*—Hermes Rodriquez
(74) *Attorney, Agent, or Firm*—Merchant and Gould P.C.

(57) ABSTRACT

The locking device comprises resilient repulsion means (58) which react between a fixed body (16) and one or more rolling members (42) and which tend to urge these members in the direction of wedging between two wedging surfaces (34, 36) associated with the body (16) and with the rod (12) of the actuator (10), respectively. A control piston (48) is arranged so as to engage the rolling members (42) in order to urge them in the release direction under the effect of a thrust exerted on the piston in the opposite direction to the force exerted by the resilient means (54).

14 Claims, 8 Drawing Sheets

Figure 1:
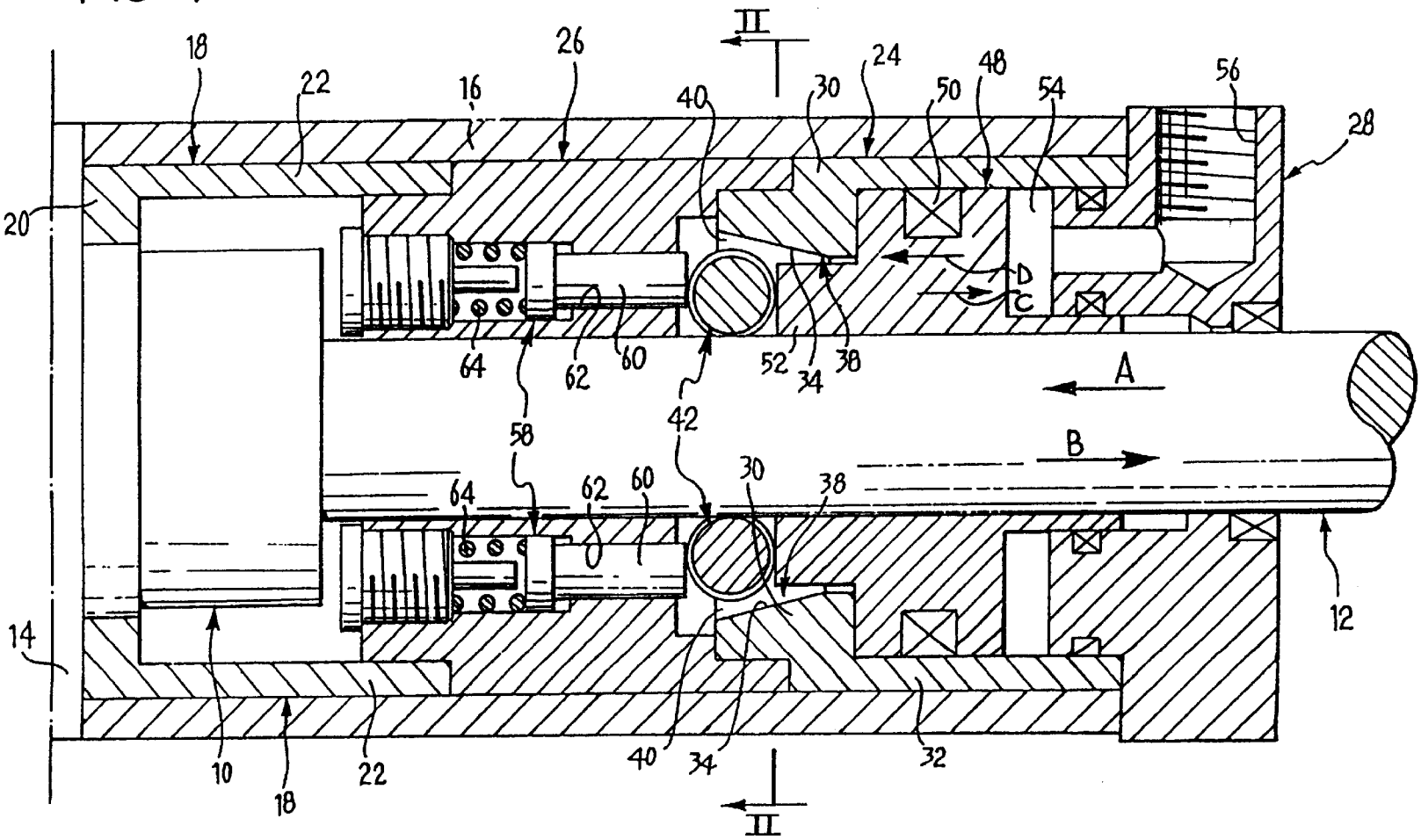

DEVICE FOR LOCKING THE SLIDING OF THE ROD OF A LINEAR ACTUATOR AND A LINEAR ACTUATOR PROVIDED WITH THE DEVICE

The present invention relates to a device for locking the sliding of the rod of a linear actuator such as, for example, a fluid actuator.

A unidirectional locking device known from the document DE-A-2 219 824 comprises:

an outer body fast with or adapted to be fastened to an end of a casing of the actuator in an arrangement such as to surround the rod, means defining, in the body, at least one pair of radially-facing wedging surfaces associated with the body and with the rod, respectively, rolling members which are disposed between the wedging surfaces of the or each pair of surfaces and which can be wedged between the surfaces as a result of their rolling in one direction and as a result of a constriction of the coupling between the wedging surfaces and the rolling members, the control piston being arranged so as to engage each rolling member in order to urge it in the release direction as a result of a thrust exerted on the piston in the opposite direction to the force exerted by the resilient repulsion means, and resilient repulsion means reacting between the body and the rod through each rolling member and tending to urge the latter in the wedging direction.

In this known device, the rolling members are constituted by balls which are loosely arranged between a conical inner surface of an annular element fixed to the body of a linear fluid actuator, and a cylindrical outer surface of the rod of the actuator. The balls are not positively guided along the rod when the wedging and unwedging movements take place.

The friction between the balls and the wedging surfaces may be inadequate for ensuring effective wedging and locking, owing to the presence of oil or grease in the tapered annular space.

The object of the invention is to provide a locking device of the type defined above, which does not have the aforementioned disadvantages, and in which the rolling members are guided along the rod of the linear actuator.

According to the present invention, this object is achieved by means of a locking device of the type defined above, wherein the body or an element fixed to the body has a series of longitudinal, peripheral grooves, and in that each rolling member is guided in a respective groove as it rolls along said wedging surfaces.

A locking device according to the invention is suitable for use not only for actuators having rods of circular cross-section but also, advantageously, for actuators having rods of other, for example, prismatic cross-sections.

The wedging and release of the rolling members does not rely upon their rolling friction on the wedging surfaces; on the one hand, wedging is achieved and is always ensured by the resilient thrust of the repulsion means; on the other hand, release is achieved by means of the positive thrust of the control piston.

The invention also relates to a unit for the bidirectional locking of the sliding of the rod of a linear actuator, wherein it comprises a pair of unidirectional locking devices as claimed acting in axially opposite directions.

The invention further includes a linear actuator comprising a unidirectional locking device or a bidirectional locking unit, as claimed.

Throughout the present description and in the claims, the term "piston" indicates not only an actual piston on which a fluid pressure acts, but also an operating member such as the movable core of an electromagnet; the terms "axial", "radial", "chordal", their derivatives and similar terms indicate directions with reference to the axis of the actuator rod.

Figure 2:
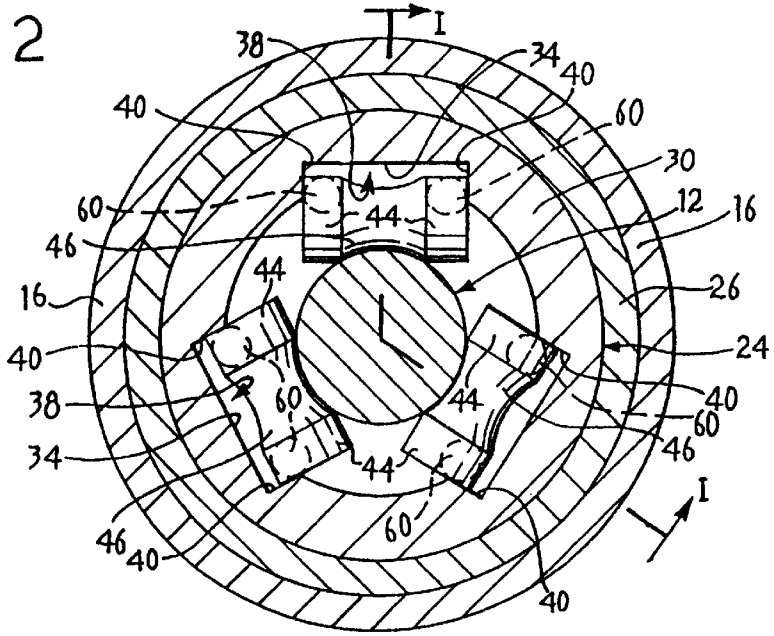
Figure 3:
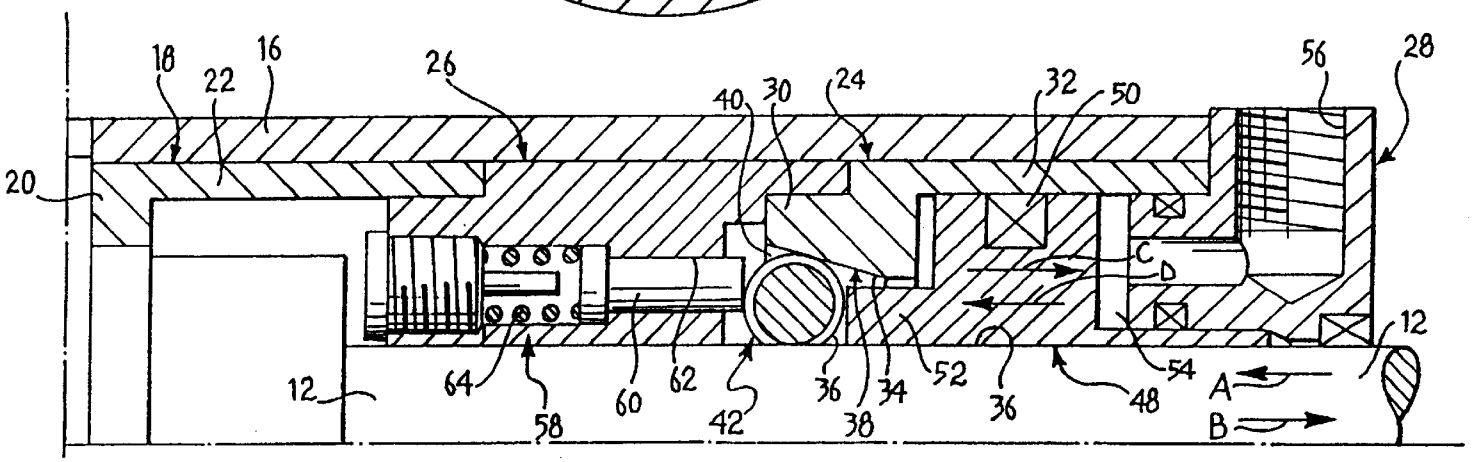
Figure 4:
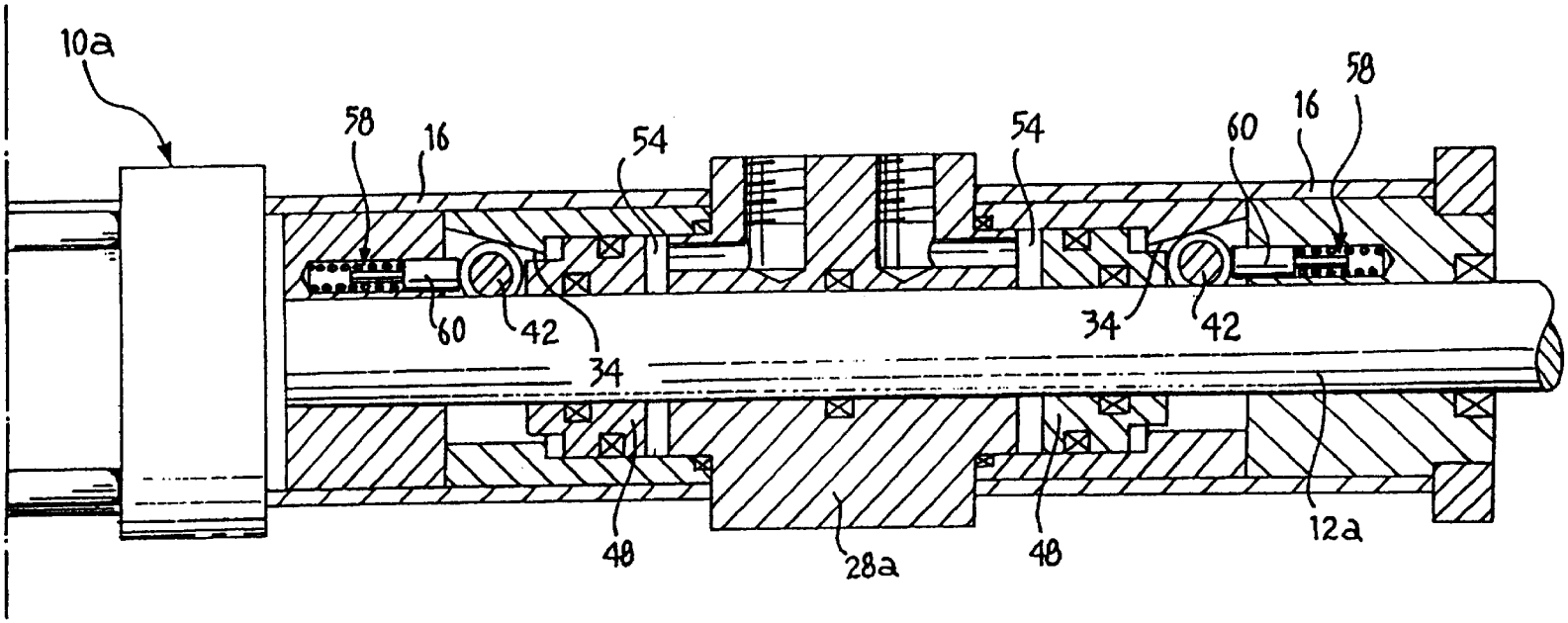
Figure 5:
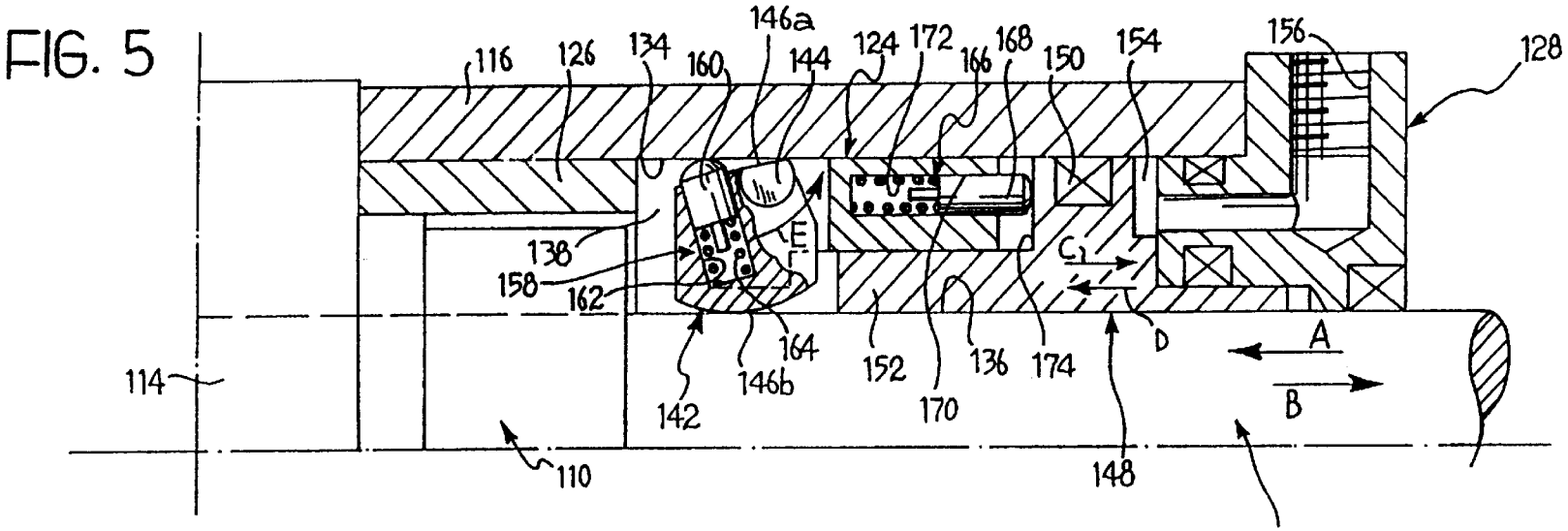
Figure 6:
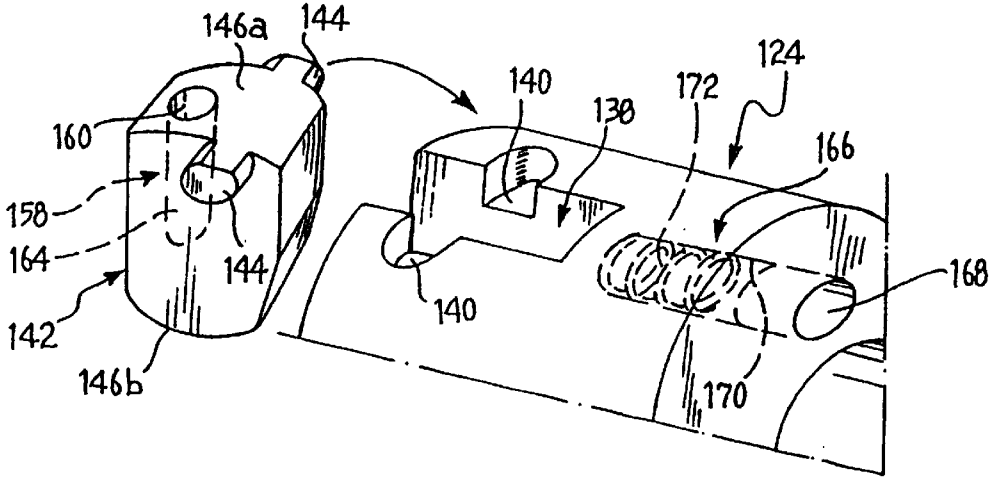
Figure 7:
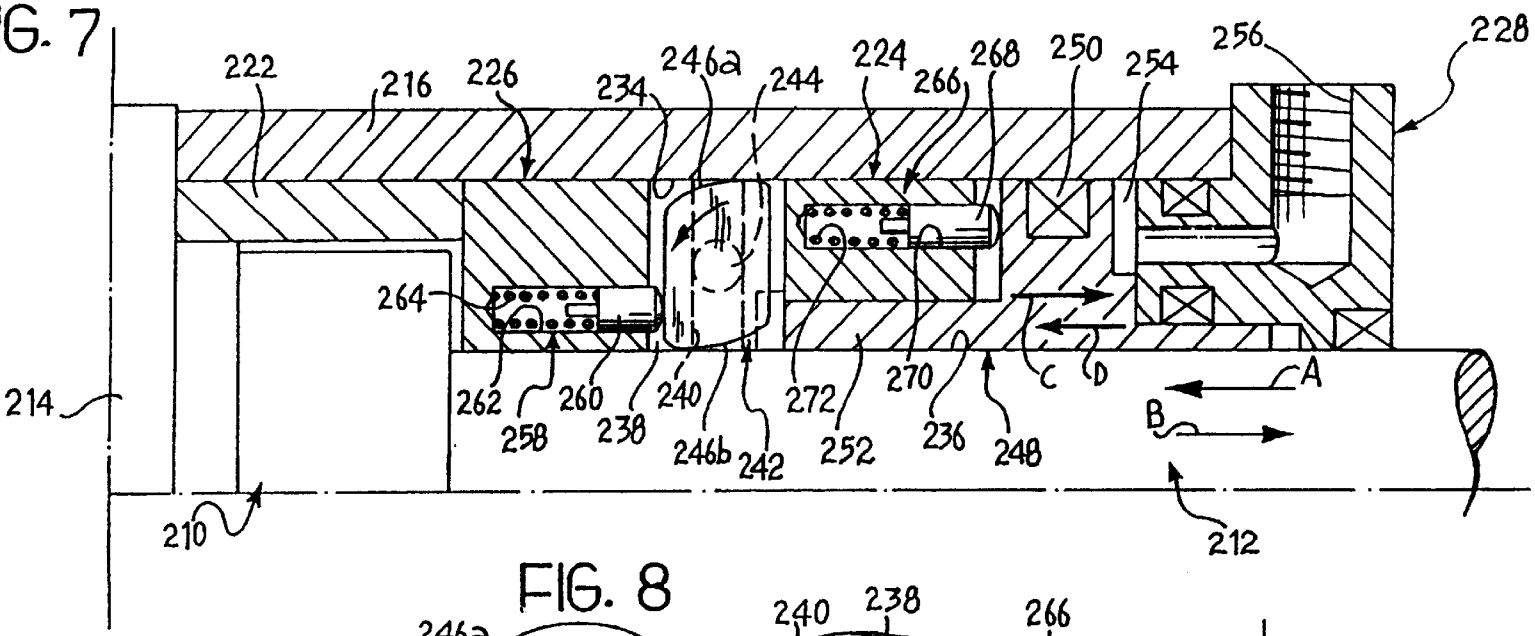
Figure 8:
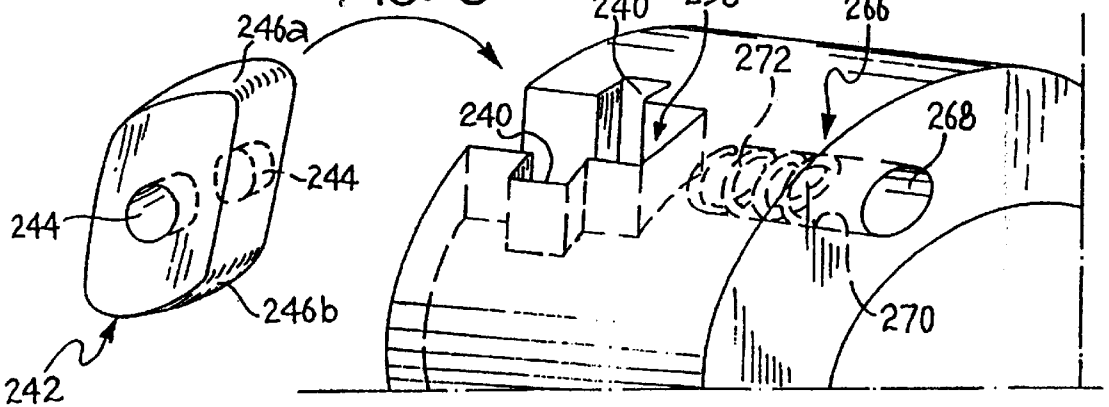
Figure 9:
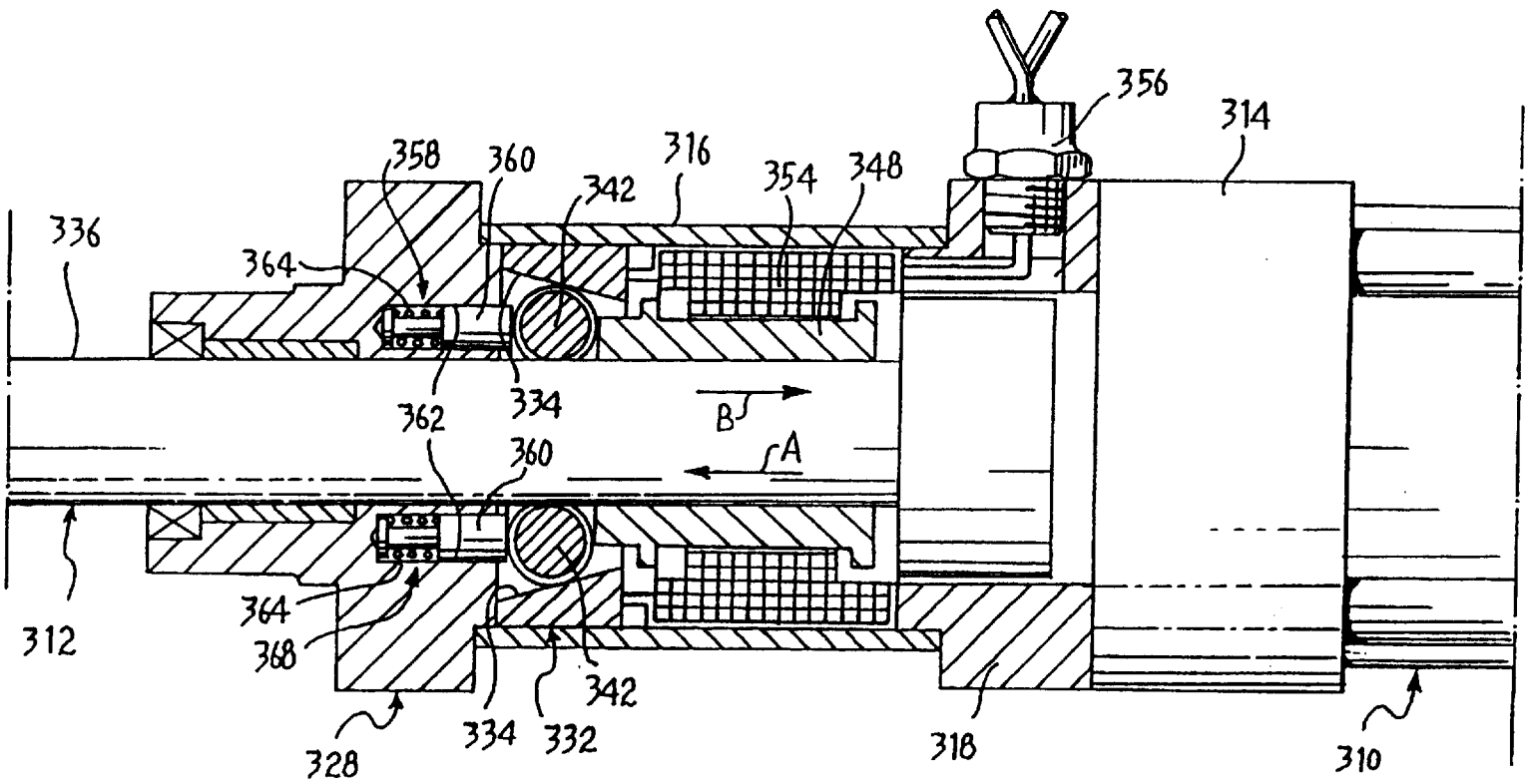
Figure 10A:
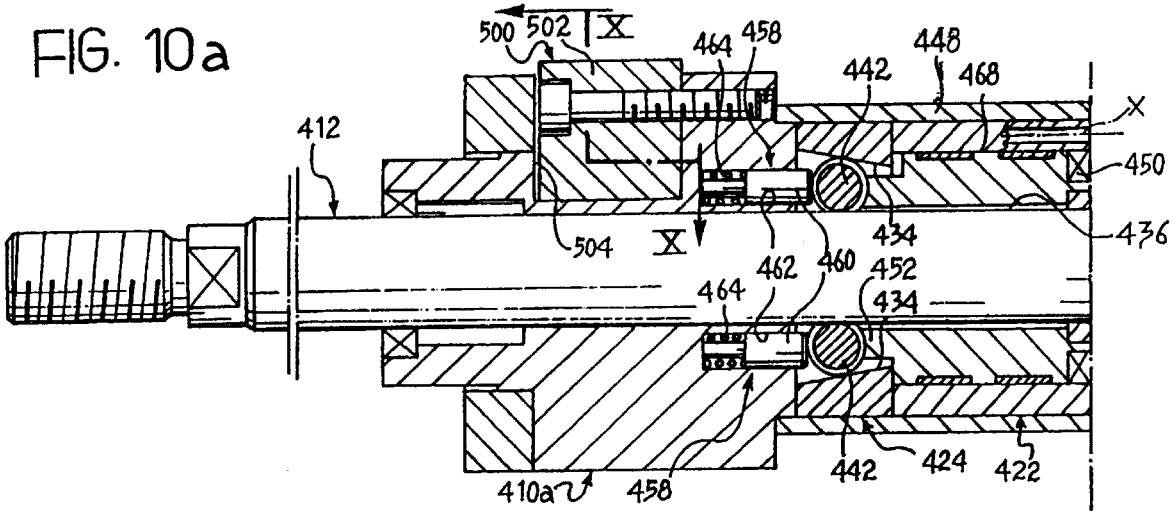
Figure 10B:
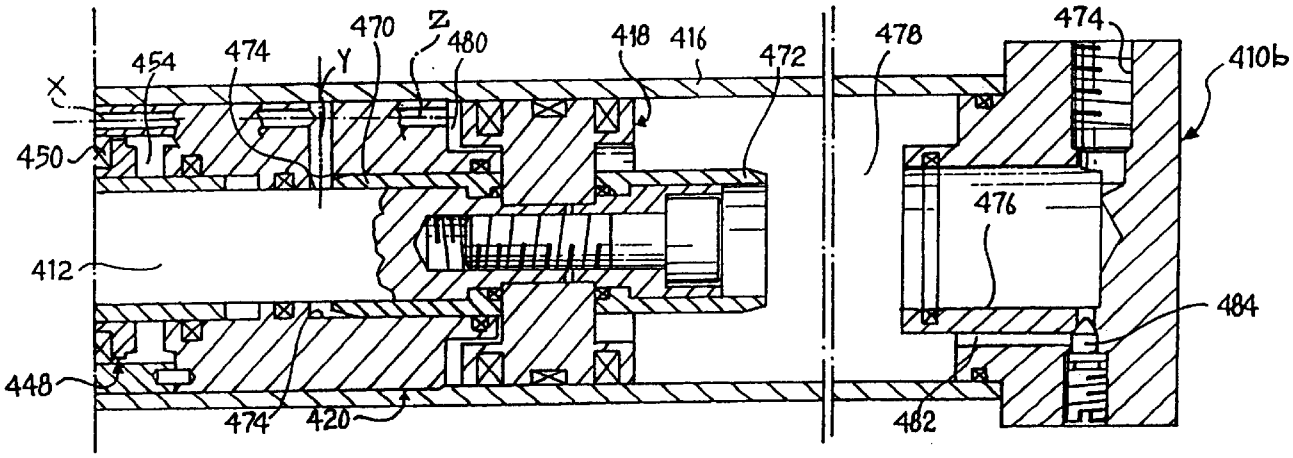
Figure 11:
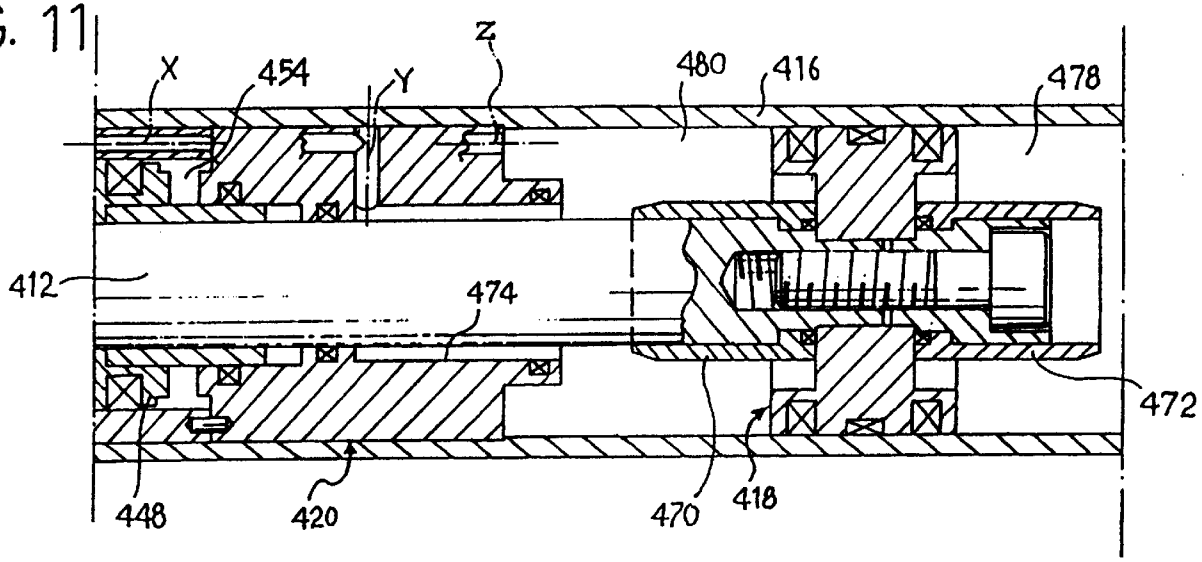
Figure 12:
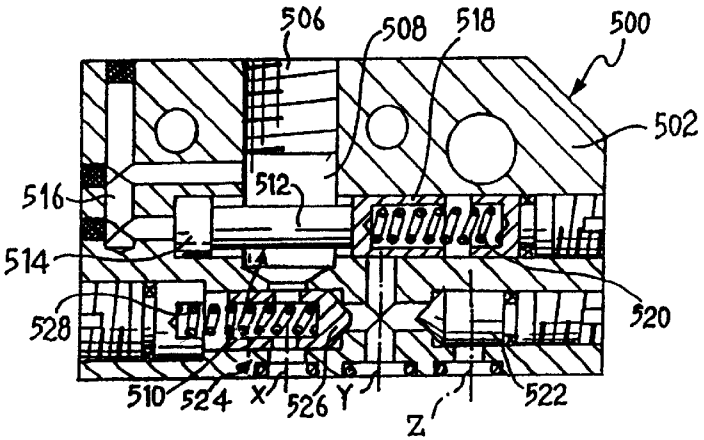

The invention will become clearer from a reading of the following description, given with reference to the appended drawings, provided by way of non-limiting example, in which:

FIG. 1 is a longitudinal section taken on the broken line I—I of FIG. 2, through a unidirectional locking device according to a first embodiment of the invention, shown in the released condition in FIG. 1, FIG. 2 is a transverse section taken on the line II—II of FIG. 1, FIG. 3 is a longitudinal half-section of the device of FIGS. 1 and 2, shown in the locking condition, FIG. 4 is a longitudinal section of a bidirectional locking unit comprising a pair of opposed unidirectional locking devices according to the first embodiment of FIGS. 1 to 3, FIG. 5 is a longitudinal half-section of a second embodiment of a unidirectional locking device, FIG. 6 is a partial, exploded, perspective view thereof, FIG. 7 is a longitudinal half-section of a third embodiment of a unidirectional locking device, FIG. 8 is a partial, exploded, perspective view thereof, FIG. 9 is a longitudinal section similar to FIG. 1 showing an electromagnetic variant of the locking device according to the invention, FIGS. 10*a* and 10*b*, taken jointly, are a longitudinal section of a fluid actuator provided with a locking device according to the invention, and of a device for braking the outward and return strokes of the actuator rod, FIG. 11 is a longitudinal section corresponding to FIG. 10*b*, in which the piston of the actuator is shown in an intermediate position between the two travel limit positions, and FIG. 12 is a section taken in the plane indicated X—X in FIG. 10*a*, showing the internal details of a sequence valve of the actuator of FIGS. 10*a*, 10*b* and 11, on an enlarged scale.

FIGS. 1 and 3 show a front end of a linear actuator 10 such as a hydraulic or pneumatic jack or an electrical linear actuator, from which a rod 12, having a circular cross-section in the embodiment shown, projects.

A small part of the head of a cylindrical casing of the actuator 10 is shown at 14.

A tubular body 16 fixed to the head 14 constitutes the casing of the unidirectional locking device which will now be described.

Towards its end facing the actuator 10, the body 16 houses a cup-shaped fixing element 18 comprising an annular flange 20 and a peripheral skirt 22.

The skirt 22 has the function of locating the body 16 radially and axially relative to the actuator casing.

The flange 20 is bolted or otherwise fixed to the corresponding end of the casing 14 of the actuator 10 and its skirt 22 is welded or otherwise fixed to the inside of the body 16.

Inside the body 16 there are two annular inserts 24 and 26. At the opposite end of the body 16 to the actuator 10, there is an annular head 28, fixed to the body 16 in a manner not shown, and locking the annular inserts 24 and 26 between it and the skirt 22 of the fixing element 18.

The insert 24 comprises a thickened annular end portion 30 remote from the head 28 and a cylindrical skirt 32, the function of which will be explained below.

With reference to FIG. 2, as well as to FIGS. 1 and 3, the thickened annular portion 30 of the insert 24 defines three radially outer wedging surfaces 34 facing radially inwardly inside the body 16.

The wedging surfaces 34 are in the form of tracks which converge (from left to right in FIGS. 1 and 3) towards the axis of the rod 12.

In the embodiment shown, which is the preferred embodiment, there are three tracks 34 disposed at intervals of 120°, as shown in FIG. 2.

Facing each outer converging track 34, the outer surface of the rod 12, indicated 36, forms a longitudinal track or wedging surface parallel to the axis of the rod 12.

In the embodiment of FIGS. 1 to 3, each converging track 34 is constituted by the base of a longitudinal groove 38 formed in the thickened annular portion 30 of the insert 24. The opposed sides of each of these grooves 38 are indicated 40.

A free rolling member 42 is disposed between the wedging surfaces 34, 36 of each pair of surfaces. As will be explained further below, the rolling member 42 can be wedged between the surfaces 34, 36 of the respective pair as a result of its rolling in one direction and as a result of a constriction of their coupling (towards the right in FIGS. 1 and 3).

In the embodiment of FIGS. 1 to 3, each rolling member 42 is constituted by a roller with a chordal axis. In particular, with a rod 12 of circular cross-section, as shown in FIGS. 1 to 3, each roller 42 is advantageously diabolo-shaped (FIG. 3) with two cylindrical end portions 44 for rolling on the respective converging track 34 and with a recessed intermediate portion 46 for rolling on the outer surface 36 of the rod 12.

Each roller 42 is restrained between the sides 40 of the respective groove 38.

With a flat inner track, not shown, on the rod and a corresponding cylindrical roller, the sides such as 40 would have the function of guiding the roller as it rolls on this track.

With reference to FIGS. 1 and 3, the skirt 32 of the insert 24 constitutes a cylinder for the sliding of an annular control piston 48 which is also slidable along the rod 12.

A peripheral annular seal 50 ensures sealing between the cylinder 32 and the piston.

On the side facing towards the rolling members or rollers 42, the piston 48 has an annular projection 52 for engaging the rollers (from right to left in FIGS. 1 and 3).

A control chamber 54 is defined on the opposite side to that facing the rollers 42, between the control piston 48 and the head 28, for receiving a pressurized fluid (oil or compressed air) from a connector 56 formed in the head 28 for connection with the exterior.

With reference once more to FIGS. 1 to 3, resilient repulsion means incorporated in the insert 26 react between the body 16 and the rod 12 through each rolling member or roller 42.

In the embodiment shown, these resilient repulsion means, generally indicated 58, comprise, for each rolling member or roller 42, a pair of thrust members 60 slidable in respective axial seats 62 of the insert 26 fixed to the body 16.

Each thrust member 60 is urged into engagement with a respective cylindrical portion 44 of the roller 42 by a respective helical compression spring 64 (or a spring of another equivalent type).

The operation of the embodiment of FIGS. 1 to 3 will now be described.

It will be assumed that the device is initially in the released condition of FIG. 1. In this condition there is pressure in the control chamber 54 and the control piston 48 is moved fully towards the left in FIG. 1.

The annular projection 52 of the piston 48 keeps the rollers 42 and the thrust members 60 moved to the left, against the force of the springs 64.

In these conditions, the rollers 42 which are in contact with the surface 36 of the rod 12 are separated from the inclined tracks 34 and are therefore not wedged. The rod 12 is thus free to slide backwards and forwards freely.

If, for example, the rod 12 is to be prevented from advancing in the direction of the arrow B at the end of a predetermined inward stroke in the direction of the arrow A, the pressure is previously removed from the control chamber 54 so that the control piston 48 is withdrawn in the direction of the arrow C.

Under the effect of the springs 64, the thrust members 60 urge the respective rollers 42 to the wedging position of FIG. 3, in which they engage the converging tracks 34 as well as the outer surface 36 of the rod 12.

The rod 12 is not obstructed during its inward movement in the direction of the arrow A since this movement tends to release the rollers 42. When this movement stops, however, an attempt by the rod 12 to move in the opposite direction, indicated by the arrow B, will only cause and increase the wedging of the rollers 42 so that this movement in the direction of the arrow B will not be possible.

To release the rod 12, it suffices simply to admit pressure to the control chamber 54 so that the piston 48 moves in the opposite direction, indicated by the arrow D of FIGS. 1 and 3 and, as it does so, its annular projection 52 urges the rollers 42 to the released position of FIG. 1, against the force of the springs 64 of the thrust members 60.

FIG. 4 shows a unit for the bidirectional locking of the sliding of the rod, indicated 12*a*, of a linear actuator 10*a*.

The bidirectional locking unit of FIG. 4 comprises a pair of unidirectional locking devices like that shown in FIGS. 1 to 3, acting in axially opposite directions.

The main elements of these two devices have been indicated by the same reference numerals as in FIGS. 1 to 3.

As will be noted, the two unidirectional locking devices are interconnected by a common intermediate head 28*a* which, as well as joining them together, performs the function of the head 28 of FIGS. 1 and 3 for both locking devices.

The operation of the unit of FIG. 4 can be inferred from the description of the operation of the device of FIGS. 1 to 3 and, for brevity, will not therefore be described in detail.

It is sufficient to say that, with reference to FIG. 4, to allow the rod 12*a* to move towards the right and to prevent it from returning towards the left, the left-hand chamber 54 will be pressurized and pressure will be removed from the right-hand control chamber 54, in order to prevent wedging of the left-hand rollers 42 and to permit wedging of the right-hand rollers 42, respectively; conversely, to allow the rod 12*a* to move towards the left and prevent it from returning towards the right, the right-hand control chamber 54 will be pressurized and the pressure will be removed from the left-hand control chamber 54, to prevent wedging of the right-hand rollers 42 and to permit wedging of the left-hand rollers 42, respectively.

Reference will now be made to FIGS. 5 and 6 to describe a second embodiment of the unidirectional locking device according to the invention.

In FIGS. 5 and 6, parts identical or similar to those of FIGS. 1 to 3 or having an equivalent function have, as far as possible, been indicated by the same reference numerals increased by 100.

The description with reference to FIGS. 5 and 6 will be limited essentially to the parts which differ from those of the first embodiment of FIGS. 1 to 3.

Inside the tubular body 116 there is a pack of two inserts 124 and 126 locked between a head 114 corresponding to the front end of the casing of the actuator 110, and an opposed head 128.

The insert 126 is a simple spacer sleeve. The insert 124 is in the form of a sleeve which is fixed to the body 116 and in which the rod 112 slides.

In FIGS. 5 and 6, the wedging surfaces, indicated 134 and 136, are parallel both to one another and to the axis of the rod 112. In particular, the wedging surface 134 is the radially inner surface of the body 116 of the locking device, and the wedging surface 136 is the outer surface of the rod 112.

The sleeve 124 has a series of longitudinal, peripheral grooves 138, for example, three grooves disposed at intervals of 120° like the grooves 38 of FIG. 2.

Notches or lateral seats 140 are formed, starting from each groove 138, in the radially outer region adjacent the inner surface 134 of the body 116.

A rolling member 142 in the form of a cam is fitted and guided in each groove 138.

The cam 142 is pivotable about a chordal axis which is fixed relative to the body 116, adjacent the wedging surface 134. For this purpose, the cam 142 has opposed lateral pivot pins 144 housed in the seats 140.

The cam 142 has arcuate surfaces 146*a*, 146*b* which are eccentric relative to the pivot axis defined by the pivot pins or fulcra 144. These arcuate surfaces 146*a*, 146*b* engage the respective wedging surfaces 134, 136.

In the transverse direction, the surface 146*b* will preferably be arcuate with convex curvature if the rod 112 is cylindrical, but will be straight if the rod has a flat wedging track.

In the latter case, the or each roller may have the function of preventing the rod from rotating about its axis.

Resilient repulsion means, generally indicated 158, are incorporated in the cam 142. These resilient repulsion means have the same function as the resilient repulsion means 58 of FIGS. 1 and 3.

In particular, the resilient repulsion means 158 comprise a thrust member 160 slidable in an oblique seat 162 in the cam 142 and repelled by a spring 164 so that the thrust member 160 constantly acts against the wedging surface 134 of the body 116.

The arrangement of the resilient repulsion means 158 is such that they cause the cam 142 to pivot in the wedging sense, indicated by the arrow E in FIG. 5.

As will be explained further below, an annular projection 152 of the piston 148 can engage the cam 142 in a position such as to cause it to pivot in the release sense, that is, the opposite sense to that indicated by the arrow E, against the force of the repulsion means 158.

The unidirectional locking device of FIGS. 5 and 6 has further resilient repulsion means, generally indicated 166, which could also be incorporated in the embodiment of FIGS. 1 to 3.

These resilient repulsion means 166 urge the control piston 148 in the wedging direction in the absence of pressure in the control chamber 154. This constitutes a guarantee against any tendency of the piston 148 to remain in the position to which it advances towards the cams 142, which condition could obstruct the wedging of the cams.

As shown, the resilient repulsion means 166 preferably comprise one or more thrust members 168 slidable in respective axial seats 170 of the insert 124 and urged by respective springs 172 against a corresponding annular radial face 174 of the piston 148.

The operation of the device of FIGS. 5 and 6 is similar to that of the device of FIGS. 1 to 3.

If, for example, the rod 112 is to be prevented from returning in the direction of the arrow B at the end of a predetermined inward stroke in the direction of the arrow A, the pressure is previously removed from the control chamber 154 so that the control piston 148 is withdrawn in the direction of the arrow C to the position shown in FIG. 5.

Under the effect of the springs 164, the thrust members 160 keep the respective cams 142 in an incipient wedging position in which their arcuate surfaces 146*a* and 146*b* engage the wedging surfaces 134 an 136, respectively.

The rod 112 is not obstructed during its inward movement in the direction of the arrow A since this movement tends to release the cams 142. When this movement stops, however, an attempt by the rod 112 to move in the opposite direction indicated by the arrow B will only increase the wedging of the cams 142 so that this movement in the direction of the arrow B will not be possible.

To release the rod 112, it suffices simply to admit pressure to the control chamber 154 so that the piston 148 will move in the opposite direction, indicated by the arrow D of FIG. 5 and, as it does so, its annular projection 152 will urge the cams 142 to the release position, against the force of the springs 164 of the thrust members 160 and against the force of the springs 172 of the thrust members 178.

Reference will now be made to FIGS. 7 and 8 to describe a third embodiment of a unidirectional locking device according to the invention.

In FIGS. 7 and 8, parts identical or similar to those of the preceding embodiments or having equivalent functions have, as far as possible, been indicated by the same reference numerals increased by 200 in comparison with FIGS. 1 to 3.

The description with reference to FIGS. 7 and 8 will also be limited essentially to the parts which differ from those of the preceding embodiments.

Inside the tubular body 216 there are two inserts 224 and 226 locked between a tubular spacer 222, which may be a skirt like that of FIGS. 1 and 3, and an opposed head 228.

Both of the inserts 224 and 226 are in the form of sleeves in which the rod 212 slides.

In FIGS. 7 and 8, the wedging surfaces, indicated 234 and 236, are parallel both to one another and to the axis of the rod 212. In particular, the wedging surface 234 is the radially inner surface of the body 216 of the locking device, whereas the wedging surface 236 is the outer surface of the rod 212.

The sleeve 224 has a series of longitudinal, peripheral grooves 238, for example, three grooves, arranged at intervals of 120° like the grooves 138 of FIG. 6.

Facing radial grooves 240, the function of which will be explained below, are formed in the two sides of the longitudinal grooves 238.

A rolling member 242, in the form of a cam, is fitted and guided in each longitudinal groove 238.

The cam 242 is pivotable about a chordal axis which is fixed axially and movable radially relative to the body 216. For this purpose, the cam 242 has opposed lateral pivot pins 244 housed in the radial grooves 240.

The cam 242 has arcuate surfaces 246*a*, 246*b* which are eccentric and symmetrical relative to the pivot axis defined by the pivot pins or fulcra 244. These arcuate surfaces 246*a*, 246*b* engage the respective wedging surfaces 234, 236.

Resilient repulsion means, generally indicated 258, are associated with the cam. These resilient repulsion means have the same function as the resilient repulsion means 58 of FIGS. 1 and 3 and the resilient repulsion means 158 of FIGS. 7 and 8.

In particular, the resilient repulsion means 258 comprise, for each cam 242, a thrust member 260 slidable in an axial seat 262 of the insert 226 and repelled by a spring 264 so that the thrust member 260 constantly acts against the cam 242 in a position such as to cause the cam 242 to pivot in the wedging sense, indicated by the arrow E in FIG. 7.

As will be explained further below, an annular projection 252 of the piston 248 can engage the cam 242 in a position such as to cause it to pivot in the release sense, that is, in the opposite sense to the arrow E, against the force of the repulsion means 258.

The unidirectional locking device of FIGS. 7 and 8 also has further resilient repulsion means, generally indicated 266, which have the function of biasing the control piston 248, this function being identical to the function of the resilient repulsion means 166 of FIGS. 5 and 6.

For brevity, the details of the resilient repulsion means 266 and their function will not be described further.

The operation of the device of FIGS. 7 and 8 is similar to that of the device of FIGS. 5 and 6.

For example, if the rod 212 is to be prevented from returning in the direction of the arrow B at the end of a predetermined inward stroke in the direction of the arrow A, the pressure is previously removed from the control chamber 254 so that the control piston 248 is withdrawn in the direction of the arrow C to the position shown in FIG. 7.

Under the effect of the springs 264, the thrust members 260 keep the respective cams 242 in an incipient wedging position, in which their arcuate surfaces 246*a*, 246*b* engage the wedging surfaces 234 and 236, respectively.

The rod 212 is not obstructed during its inward movement in the direction of the arrow A since this movement tends to release the cams 242. When this movement stops, however, an attempt by the rod 212 to move in the opposite direction, indicated by the arrow B, will only increase the wedging of the cams 242 so that this movement in the direction of the arrow B will not be possible.

To release the rod 212, it suffices simply to admit pressure to the control chamber 254 so that the piston 248 will move in the opposite direction, indicated by the arrow D of FIG. 7 and, as it does so, its annular projection 252 will urge the cams 242 to the release position, against the force of the springs 264 of the thrust members 260 and against the force of the springs 272 of the thrust members 268.

Reference will now be made to FIG. 9 in order to describe an electromagnetic variant of the locking device according to the invention.

In FIG. 9, parts identical or similar to those of FIG. 1 or having equivalent functions have been indicated, as far as possible, by the same reference numerals, increased by 300.

FIG. 9 also shows a front end of a fluid or electrical linear actuator or a linear actuator of another type, from which a rod 312, again having a circular cross-section in the variant shown, projects.

The head of a cylindrical casing of the actuator 310 is shown at 314.

A tubular body 316 fixed to the head 314 constitutes the casing of the unidirectional locking device which is very similar to that of FIG. 1 and will be described only briefly below.

Towards its end facing the actuator 310, the body 316 is fixed to a respective head 318 which in turn is fixed to the head 314.

The opposite end of the body 316 to the annular head 318 is closed by another annular head 328 through which the rod 312 extends.

As in the embodiment of FIG. 1, an insert 332 housed in the body 316 has three wedging surfaces 334 in the form of tracks which converge (from left to right in FIG. 9) towards the axis of the rod 312.

In the embodiment of FIG. 9, the outer surface, indicated 336, of the rod 312 also constitutes a longitudinal track or wedging surface parallel to the axis of the rod 312.

As in the embodiment of FIGS. 1 to 3, a free rolling member 342 is disposed between the wedging surfaces 334, 336 of each pair of surfaces and can be wedged between the surfaces 334, 336 as a result of its rolling in one direction and as a result of a constriction (towards the right in FIG. 9) of their coupling.

For all details relating to the rolling members 342, reference may be made in non-limiting manner, to the embodiment of FIGS. 1 to 3.

A movable core 348 in the form of an annular soft-iron sleeve is mounted for sliding inside the body 316, on the rod 312.

The sleeve 348 constitutes a control piston, one end of which (the left-hand end in FIG. 9) can engage the rolling members 342.

The movable core 348 is surrounded by a solenoid 354 which can be energized electrically by means of cables which extend through a connector 356 screwed sealingly into the head 318.

As in the embodiment of FIG. 1, resilient repulsion means incorporated in the head 328 react between the body 316 and the rod 312 through each rolling member 342.

In the variant of FIG. 9 these resilient repulsion means, generally indicated 358, also comprise, for each rolling member 342, a pair of thrust members 360 slidable in respective axial seats 362 of the head 328.

Each thrust member 360 is urged into engagement with a respective rolling member 342 by a respective helical compression spring 364.

The operation of the variant of FIG. 9 will now be described briefly.

It will be assumed that the device is initially in the released condition.

In this condition, the solenoid 354 is energized and the movable core 348 or control piston is moved fully to the left. In these conditions, the piston 348 keeps the rolling members 342 and the thrust members 360 moved to the left against the force of the springs 364.

Moreover, in these conditions, the rolling members 342 which are in contact with the surface 336 of the rod 312 are separated from the inclined tracks 334 and are thus not wedged. The rod 312 is thus free to slide backwards and forwards freely.

If, for example, the rod 312 is to be prevented from returning in the direction of the arrow B at the end of a predetermined outward stroke in the direction of the arrow A, the solenoid 354 is previously de-energized so that the core or control piston 348 is withdrawn in the direction of the arrow B.

As in the embodiment of FIG. 1, under the effect of the springs 364, the thrust members 360 urge the respective rolling members 342 to a wedging position (towards the right in FIG. 9) in which they engage the converging tracks 334 as well as the outer surface 336 of the rod 312.

The rod 312 is not obstructed during its outward movement in the direction of the arrow A since this movement tends to release the rolling members 342. When this movement stops, however, an attempt by the rod 312 to move in the opposite direction indicated by the arrow B will only cause and increase the wedging of the rollers 342 so that this movement in the direction of the arrow B will not be possible.

Further variants fall within the spirit of the invention. Thus, for example, unidirectional locking devices such as those of the embodiments described could be fitted to the rear end of an actuator in order to act on a rear extension of a rod.

Although in the description with reference to the drawings, devices or units comprising three rolling members and respective pairs of wedging surfaces have been considered, a locking device or unit according to the invention could also comprise only one rolling member with a respective pair of wedging surfaces or a number other than three of these elements, preferably in a radially symmetrical arrangement.

For example, the inner wedging surfaces could be formed on an element such as a bush fitted and fixed to the actuator rod.

Moreover, a locking unit could comprise two opposed unidirectional locking devices like that of FIGS. 5 and 6 or like that of FIGS. 7 and 8, as shown in FIG. 4.

The locking devices and units have been designed as accessories for commercially available fluid or electrical linear actuators but could be incorporated in an actuator during its manufacture, for example, with the use of an extension of the actuator casing as the body of the device or unit.

FIGS. 10*a*–10*b* and 11 show an example of a fluid actuator of this type which incorporates a unidirectional locking device according to the invention.

In these drawings, parts identical or similar to those of FIG. 1 have been indicated, as far as possible, by the same reference numerals, increased by 400.

In this embodiment, the unidirectional locking device, which will be described briefly, is incorporated in the fluid actuator.

The actuator comprises two heads 410*a* (FIG. 10*a*) and 410*b* (FIG. 10*b*), between which a piston rod 412 extends, projecting sealingly through the head 410*a*.

The two heads 410*a*, 410*b* are interconnected by a tubular body 416 which constitutes both the cylinder of the actuator and the casing of the unidirectional locking device which will be described below.

The piston of the actuator, generally indicated 418 (FIG. 10*b*), is fixed to a corresponding end of the rod 412 and is slidable sealingly in the tubular body 416.

Inside the body 416, at the end with the annular head 410*a*, there are three consecutive, aligned annular inserts 420, 422 and 424, which will be referred to further below.

As in the embodiment of FIG. 1, the insert 424 has three wedging surfaces 434 (FIG. 10*a*). These wedging surfaces 434 are again in the form of tracks which converge (from left to right in FIG. 10*a*) towards the axis of the rod 412.

Facing each converging outer track 434, the outer surface, indicated 436, of the rod 412 constitutes a longitudinal track or wedging surface parallel to the axis of the rod 412.

This embodiment also has a free rolling member 442 disposed between the wedging surfaces 434, 436 of each pair of surfaces. In this embodiment, each rolling member 442 can also be wedged between the surfaces 434, 436 of the respective pair as a result of its rolling in one direction and as a result of a constriction (towards the right in FIG. 10*a*) of their coupling.

Reference should be made, by way of example, to the embodiment of FIGS. 1 to 3 for all details of the insert 424, of its converging tracks 434, and of the rolling members 442.

With reference to FIGS. 10*a*, and 10*b* the annular insert 422 constitutes a cylinder for an annular control piston 448 which is also slidable along the rod 412.

An annular seal 450 ensures sealing between the insert or cylinder 422 and the control piston 448.

At the end facing the rolling members 442, the control piston 448 has an annular projection 452 for engaging the members (from right to left in FIG. 10*a*).

At the opposite end to that facing the rolling members 442, a control chamber 454 is defined between the control piston 448 and the annular insert 420 (FIG. 10*b*) and can receive a pressurized fluid from a duct X which extends through the inserts 422 and 424 and through the annular head 410*a*.

The connection of the duct X will be referred to further below.

With reference once more to FIG. 10*b*, resilient repulsion means incorporated in the annular head 410*a* react between the body 416 and the rod 412 through each rolling member 442.

In the variant of FIG. 10*a*, these resilient repulsion means, generally indicated 458, also comprise, for each rolling member 442, a pair of thrust members 460 slidable in respective axial seats 462 of the head 410*a*.

Each thrust member 460 is urged into engagement with a respective rolling member 442 by a respective helical compression spring 464 (or an equivalent spring of another type).

Before the operation of the unidirectional locking device of FIG. 10*a* is described, further details of the actuator will be described.

As can be seen in FIGS. 10*b* and 11, two opposed braking bushes 470 and 472 are fixed to the piston 418 of the actuator.

The bush 470 faces towards the annular head 410*a* and surrounds the portion of the rod 412 adjacent the piston 418.

When the rod 412 is in the outer travel-limit position as in FIG. 10*b*, the piston 418 is disposed against the insert 420 and the braking bush 470 is in a cylindrical cavity 474 inside this insert.

A duct Y opening into the cavity 474 extends through the inserts 422 and 424 and through the annular head 410*a*. The function of the duct Y will also be explained below.

In the head 410*b* (FIG. 10*b*) there is a connector 474 for connection to a source of pressurized hydraulic or pneumatic fluid for bringing about the outward stroke of the actuator.

The connector 474 communicates with a central cylindrical cavity 476 of the head 410*b* which can house the braking bush 472 when the piston 418 and the rod 412 are in the contracted position of the actuator.

The working chamber of the actuator which is between the head 410*b* and the piston 418 is indicated 478 in FIGS. 10*b* and 11; the other working chamber of the actuator which is between the piston 418 and the annular insert 420 is indicated 480.

As well as opening directly into the working chamber 478 in order to receive the braking bush 472, the braking cavity 476 of the head 410*b* also communicates with the working chamber 478 through a duct 482 which opens into the base of the cavity 476 and in which a choking device 484 with an adjustable screw pin is interposed.

A duct Z opening into the working chamber 480 extends through the inserts 420, 422 and 424 as well as through the annular head 410*a*. The connection of the duct Z will be referred to further below.

When, in order to contract the actuator, pressurized fluid is admitted to the working chamber 480, whilst the working chamber 478 is exhausted through the connector 474, the piston 418 moves towards the head 410*b* (towards the right in FIG. 10*b*) and, at a certain point, the bush 472 enters the braking cavity 476 thus closing the direct communication between the chamber 478 and the connector 474 through the cavity 476.

At this point, the fluid can be exhausted from the chamber 478 towards the connector 474 solely through the choked duct 484 so that the unit constituted by the piston 418 and the rod 412 is braked until it stops.

The unit constituted by the piston 418 and the rod 412 is braked in the same way at the end of its outward stroke when the braking bush 470 enters the braking cavity 474 of the annular insert 420 as it moves towards the left in FIG. 11.

Before the bush 470 enters the cavity 474, the fluid present in the working chamber 480 is exhausted freely through the duct Y; when the bush 470 has closed the cavity 474, however, the fluid can be exhausted solely through the duct Z. In order to bring about braking, the exhausting of the fluid through the duct Z must be choked.

A sequence valve, shown in detail in FIG. 12, provides, amongst other functions, for the choking of the duct Z, its function being both to control the release of the rod 412 as a result of the release of the rolling members 442 (FIG. 10*a*) simultaneously with the operation of the actuator in the contraction direction, and to control the braking of the unit constituted by the piston 418 and the rod 412 towards the end of its extension stroke.

This sequence valve, indicated 500, may consist of a component separate from the actuator but, preferably, as shown in FIG. 10*a*, comprises a block 502 fitted and fixed in a housing 504 of the head 410*a* (FIG. 10*a*).

With reference now to FIG. 12, the block 502 has a connector 506 for external connection and three connectors, also indicated X, Y and Z, which are connected to the respective ducts X, Y and Z of FIG. 10*b*.

The connector 506 communicates permanently with the duct X through a main duct 508.

A cylindrical spool valve 510 associated with the main duct 508 has a rod 512 which extends transversely through this duct.

One end of the rod 512 (the left-hand end in FIG. 12) has a pilot piston 514 the top of which communicates with the main duct 508 through a bypass duct 516.

The other end of the rod 512 (the right-hand end in FIG. 12) is formed as an obturator spool 518.

The spool 518 is urged by a helical spring 520 to a position in which it blocks communication between the main duct 508 and the duct Y and is movable (towards the right in FIG. 12), as a result of the pressure exerted on the pilot piston 514 from the duct 508 and through the duct 516, to a position in which it opens this communication.

The duct Y and the duct Z communicate with one another through a choke defined by an adjustable screw choking device 522, the function of which is the same as that of the choking device 484 of FIG. 10*b*.

The duct Y can communicate with the main duct 508 and its connector 506 by means of a check valve 524 comprising an obturator 526 which can be opened in the direction from the duct Y to the main duct 508, against the force of a helical spring 528.

The operation of the sequence valve 500 of FIG. 12 and of the respective actuator during the contraction and extension strokes of the actuator will now be described.

At the start of the contraction stroke, the actuator is in the condition of FIGS. 10*a* and 10*b* with the rod 412 locked by the wedging of the rolling members 442.

In order to bring about the contraction stroke, pressurized fluid is admitted through the connector 506.

The pressurized fluid goes directly to the duct X and reaches the control chamber 454 causing the piston 448 to move (towards the left in FIG. 10*a*) so that the rolling members 442 are released and the rod 412 becomes free to slide.

When, at the end of the stroke of the control piston 448, the pressure in the chamber 454 has reached its maximum line pressure, this pressure is reflected through the duct 516 onto the top of the piston 514, thus urging the spool 510 towards the right (in FIG. 12) against the force of the spring 520.

The obturator 518 then reaches a position in which it puts the main duct 508 into communication with the ducts Y and Z, and hence with the working chamber 480 (FIG. 10*b*), with a slight delay after release.

The pressure of the fluid in the working chamber 480 acts on the piston 418 (towards the right in FIG. 10*b*).

The aforementioned slight delay ensures that the movement of the piston 418 during the contraction stroke of the actuator starts after the release resulting from the release of the rolling members 442 (FIG. 10*a*).

The contraction stroke continues to the end, the bush 472 entering the braking cavity 476 (FIG. 10*b*) and the resulting braking taking place as described above.

In order to bring about the extension stroke of the actuator, pressurized fluid is admitted to the connector 474 (FIG. 10*b*) and the pressure is removed from the connector 506 (FIG. 12).

Whilst the fluid pressure acts in the working chamber 478, a larger portion of the fluid from the chamber 480 is exhausted through the duct Y and a smaller portion through the duct Z.

The spool 518 of the valve 510 is in the closure position of FIG. 12 but the fluid can be exhausted into the main duct 508 and into the connector 506 through the check valve 524 which is moved to the open position (towards the left in FIG. 12) against the force of the spring 528.

When the braking bush 470 (FIGS. 10*b* and 11) enters the braking cavity 474 the duct Y is closed and the fluid can be exhausted solely through the duct Z choked by the choking device 522 and is then discharged through the open check valve 524.

The last braked portion of the extension stroke of the actuator thus takes place until the position shown in FIG. 10*b* is reached.

In the meantime, the absence of pressure in the main duct 508 and in its connector 506 has allowed the control piston 448 to remain in the position corresponding to the wedging of the rolling members 442 (on the right-hand side in FIG. 10*a*). Since, however, the rod 412 moves towards the left during the extension stroke its movement tends to release the rolling members 442 so that the locking device remains inactive.

At the end of the extension stroke, in the absence of pressure in the connector 506 (FIG. 12) and in the connector 474 (FIG. 10*b*), the resilient repulsion means 458 keep the rolling members 442 wedged, ensuring that the rod 412 cannot move towards the retracted or contracted position (towards the right in FIG. 10*a*).

What we claim is:

1. A device for the unidirectional locking of the sliding of the rod of a linear actuator, the device comprising:

an outer body fast with or adapted to be fastened to an end of a casing of the actuator in an arrangement such as to surround the rod, means defining, in the body, at least one pair of radially-facing wedging surfaces associated with the body and with the rod, respectively, rolling members which are disposed between the wedging surfaces and which can be wedged between the surfaces as a result of their rolling in one direction and as a result of a constriction of the coupling between the wedging surfaces and the rolling member, each rolling member being rotatable around a chordal axis, resilient repulsion means reacting between the body and the rod through each rolling member and tending to urge the latter in the wedging direction, and a control piston slidable longitudinally in the body and co-operating with each rolling member in order to bring about the rolling thereof, the control piston being arranged so as to engage each rolling member in order to urge it in the release direction as a result of a thrust exerted on the piston in the opposite direction to the force exerted by the resilient repulsion means, wherein:

the body or an element fixed to the body has a series of longitudinal, peripheral grooves, and each rolling member is rotatable about a chordal axis and is guided in a respective groove as it rolls along said wedging surfaces, each rolling member has generatrices of uniform radius and the wedging surfaces of the respective pair of surfaces converge in the direction of wedging, one of the wedging surfaces of the pair is constituted by a longitudinal track of the rod parallel to the axis thereof, and the other wedging surface is constituted by a track fixed relative to the body and converging towards the longitudinal track, and in that the respective rolling member is a roller with a chordal axis, and wherein the converging track is constituted by the base of a respective longitudinal groove which has sides restraining the roller.

2. A locking device as claimed in claim 1, wherein the rod has a circular cross-section at least in the region of each roller, and each roller is diabolo-shaped with two cylindrical end portions for rolling on the converging track and with an intermediate recessed portion for rolling on the rod.

3. A locking device as claimed in claim 1, wherein the resilient repulsion means are constituted, for each rolling member, by at least one thrust member having a spring and being slidable in a respective axial seat of the body or of an element fixed to the body.

4. A locking device as claimed in claim 1, wherein the piston has resilient repulsion means associated thereto, which tend to urge it in the direction of wedging in the absence of pressure in the control chamber.

5. A locking device as claimed in claim 4, wherein the means for repelling the piston resiliently in the direction of wedging comprise one or more thrust members having springs and being slidable in respective axial seats formed in an element fixed to the body or in the body itself.

6. A locking device as claimed in claim 1, wherein the device comprises a control chamber situated between the body and the rod for receiving a pressurized fluid, and wherein the control piston is movable in the control chamber under the thrust of the pressurized fluid in the direction for releasing the rolling members.

7. A locking device as claimed in claim 1, wherein the control piston is constituted by a movable core fixed to the rod of an electromagnet and wherein the electromagnet comprises a solenoid which can be energized in order to move the movable core in the direction for releasing the rolling members.

8. A locking device as claimed in claim 1, wherein the resilient repulsion means are constituted, for each rolling member, by at least one thrust member having a spring and being slidable in a respective axial seat of the body or of an element fixed to the body.

9. A locking device as claimed in claim 1, wherein the piston has resilient repulsion means associated thereto, which tend to urge it in the direction of wedging in the absence of pressure in the control chamber.

10. A locking device as claimed in claim 9, wherein the means for repelling the piston resiliently in the direction of wedging comprise one or more thrust members having springs and being slidable in respective axial seats formed in an element fixed to the body or in the body itself.

11. A locking device as claimed in claim 1, wherein the device comprises a control chamber situated between the body and the rod for receiving a pressurized fluid, and wherein the control piston is movable in the control chamber under the thrust of the pressurized fluid in the direction for releasing the rolling members.

12. A locking device as claimed in claim 1, wherein the control piston is constituted by a moveable core fixed to the rod of an electromagnet and wherein the electromagnet comprises a solenoid which can be energized in order to move the movable core in the direction for releasing the rolling members.

13. A device for the unidirectional locking of the sliding of the rod of a linear actuator, the device comprising:

an outer body fast with or adapted to be fastened to an end of a casing of the actuator in an arrangement such as to surround the rod, means defining, in the body, at least one pair of radially-facing wedging surfaces associated with the body and with the rod, respectively, rolling members which are disposed between the wedging surfaces and which can be wedged between the surfaces as a result of their rolling in one direction and as a result of a constriction of the coupling between the wedging surfaces and the rolling member, each rolling member being rotatable around a chordal axis, resilient repulsion means reacting between the body and the rod through each rolling member and tending to urge the latter in the wedging direction, and a control piston slidable longitudinally in the body and co-operating with each rolling member in order to bring about the rolling thereof, the control piston being arranged so as to engage each rolling member in order to urge it in the release direction as a result of a thrust exerted on the piston in the opposite direction to the force exerted by the resilient repulsion means, wherein:

the body or an element fixed to the body has a series of longitudinal, peripheral grooves, and each rolling member is rotatable about a chordal axis and is guided in a respective groove as it rolls along said wedging surfaces, each rolling member is in the form of a cam, and wherein the wedging surfaces of the respective pair are parallel both to one another and to the axis of the rod, one of the wedging surfaces is constituted by a longitudinal surface of the rod, and the cam is rotatable about an intermediate chordal axis, fixed axially and movable radially relative to the body, and has opposed eccentric arcuate surfaces for engagement with the respective wedging surfaces which are eccentric and symmetrical relative to the chordal axis.

14. A locking device as claimed in claim 13, wherein each rolling member has resilient repulsion means associated thereto, which are constituted by a thrust member having a spring, being slidable in a respective oblique seat of the cam, and reacting against the wedging surface of the body or of the element fixed to the body.

* * * * *

UNITED STATES PATENT AND TRADEMARK OFFICE

CERTIFICATE OF CORRECTION

PATENT NO. : 6,186,047 B1 
DATED : February 13, 2001
INVENTOR(S) : Baruffaldi

It is certified that error appears in the above-identified patent and that said Letters Patent is hereby corrected as shown below:

Drawings,
Sheet 7 of 8, Fig. 10a, reference numeral "448" has been replaced with -- 416 -- and is shown correctly in Fig. 10a below; and reference numeral "468" has been replaced with -- 448 -- and is shown correctly in Fig. 10 a below:

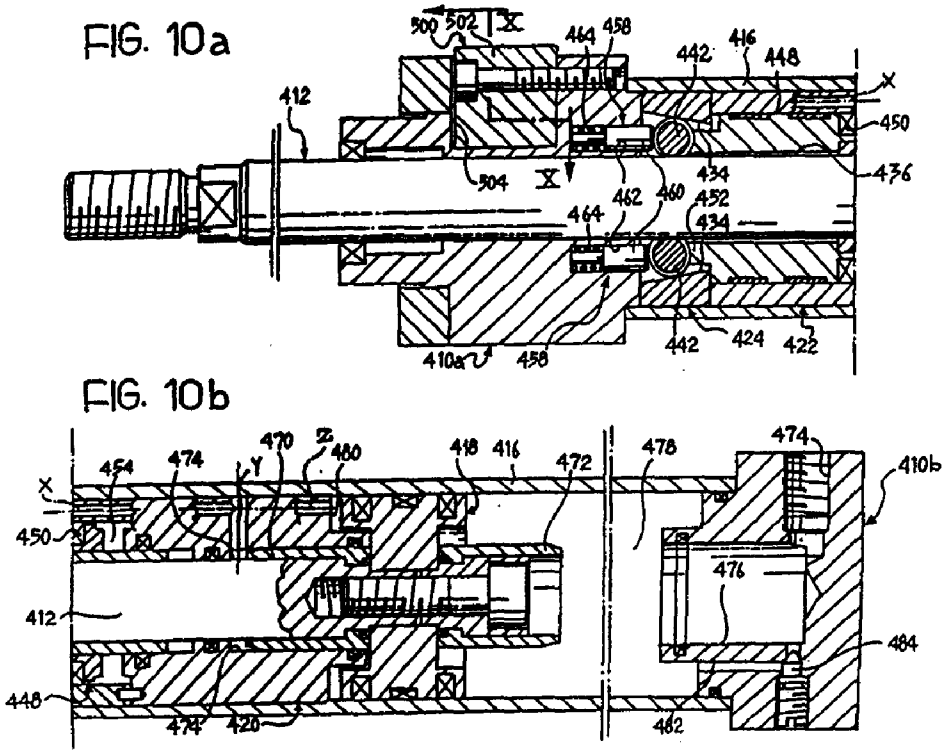

UNITED STATES PATENT AND TRADEMARK OFFICE

CERTIFICATE OF CORRECTION

PATENT NO. : 6,186,047 B1
DATED : February 13, 2001
INVENTOR(S) : Baruffaldi

It is certified that error appears in the above-identified patent and that said Letters Patent is hereby corrected as shown below:

Title page,
Item [73], Assignee, "Turin" should read -- Torino --
Item [86], PCT § 371 Date, "August 13, 1999" should read -- August 13, 1998 --
Item [86], PCT § 102(e) Date, "August 13, 1999" should read -- August 13, 1998 --

Signed and Sealed this

Eleventh Day of June, 2002

*Attest:*

*Attesting Officer*

JAMES E. ROGAN
*Director of the United States Patent and Trademark Office*